US007798762B2

(12) United States Patent
Baba

(10) Patent No.: US 7,798,762 B2
(45) Date of Patent: Sep. 21, 2010

(54) CABLE HOLDING DEVICE

(75) Inventor: Kiyokazu Baba, Komatsu (JP)

(73) Assignee: Komatsu Ltd., Tokyo (JP)

( * ) Notice: Subject to any disclaimer, the term of this patent is extended or adjusted under 35 U.S.C. 154(b) by 929 days.

(21) Appl. No.: 11/597,807

(22) PCT Filed: Apr. 28, 2005

(86) PCT No.: PCT/JP2005/008202

§ 371 (c)(1),
(2), (4) Date: Nov. 28, 2006

(87) PCT Pub. No.: WO2005/115656

PCT Pub. Date: Dec. 8, 2005

(65) Prior Publication Data

US 2008/0085178 A1 Apr. 10, 2008

(30) Foreign Application Priority Data

May 31, 2004 (JP) ..... 2004-161903

(51) Int. Cl.
*B65G 65/08* (2006.01)

(52) U.S. Cl. ..... 414/749.1; 100/207

(58) Field of Classification Search ..... 414/749.1, 414/751.1, 752.1, 918; 74/490.02; 100/207; 212/253; 248/49, 58, 61, 65, 74.3
See application file for complete search history.

(56) References Cited

FOREIGN PATENT DOCUMENTS

| | | |
|---|---|---|
| JP | 60-33839 | 2/1985 |
| JP | 1-118832 | 8/1989 |
| JP | 1-197032 | 8/1989 |
| JP | 2002-126839 | 5/2002 |
| JP | 2004-216452 | 8/2004 |

*Primary Examiner*—Donald Underwood
(74) *Attorney, Agent, or Firm*—Wenderoth, Lind & Ponack, L.L.P.

(57) ABSTRACT

A cable holding device for a work transfer device that transfers a workpiece between mutually adjacent press machines. The cable holding device is used for the work transfer device that is provided with a supporting portion (3) disposed on a support member (2) placed between press machines (P1, P2) and swingably supports a transfer arm (5). The cable holding device (10) comprises a rack arm (11) that is swingably connected to the top end of the transfer arm (5) and holds a part of the cable; a slide supporter (12) that is disposed above the transfer arm, swingably connects the rack arm (11), and vertically moved via the rack arm as the transfer arm moves; and a cable support (13) that has its one end connected to the slide supporter and its other end connected to a cable fixing portion (6) that is disposed in a direction intersecting a transfer direction of the work with respect to the slide supporter, supports a part of the cable. Even if the space between the mutually adjacent press machines is narrow, the cable can be effectively treated, and thus the pitch between the press machines can be smaller.

3 Claims, 10 Drawing Sheets

PRIOR ART

PRIOR ART

PRIOR ART

CABLE HOLDING DEVICE

TECHNICAL FIELD

The present invention relates to a cable holding device for a work transfer device that comprises a supporting portion that is provided to a supporting member placed between mutually adjacent press machines, and a transfer arm that is rotatably supported by the supporting portion, so that the work transfer device transfers a workpiece between the mutually adjacent press machines in a way that work holding means provided to a bottom end of the transfer arm is moved toward a work transfer direction.

BACKGROUND ART

As shown in FIG. 7, a tandem press line which comprises plural press machines disposed in parallel is configured to have a work transfer device A disposed between mutually adjacent press machine P1 and press machine P2, to discharge the work from the press processing position of the previous step by the work transfer device A and to feed the work into the press processing position of the next step.

The above-described work transfer device A is provided with a beam B which is extended in the horizontal direction along the work transfer direction and installed between the mutually adjacent press machine P1 and press machine P2, and a carrier (supporting portion) C which is moved in the longitudinal direction (work transfer direction) of the beam B by drive means (not shown).

Additionally, the work transfer device A is provided with a transfer arm E with a work holding means D such as a vacuum cup device disposed at the bottom end, and the transfer arm E is supported to be oscillatable to the carrier C and movable along its axial direction by drive means (not shown).

The above-mentioned work transfer device A is configured such that the carrier C is moved along the beam B, the transfer arm E is oscillated with respect to the carrier C and moved in its axial direction, and the work holding means D is moved horizontally as indicated by arrow L to transfer the work between the press machine P1 and the press machine P2.

Here, a power line and a signal line for driving the transfer arm E and cables such as hydraulic piping, air piping and the like for operating the work holding means D which is disposed at the bottom end of the transfer arm E are extended from the top end of the transfer arm E in the work transfer device A, and these cables are connected to a power source, an air compressor and the like which are separately disposed on the press machines P1, P2.

Meanwhile, the above-mentioned transfer arm E exhibits complex behavior to horizontally move the work holding means D as described above, and the top end of the transfer arm E requires a particularly large range of motion. Therefore, it is necessary to treat the cable so as not to be swung around by the movement of the transfer arm E.

As a device capable of appropriately treating the cable, a cable holding device which is provided with a mechanism which can hold the middle part of the cable and can follow the movement of the movable body is provided.

A conventional cable holding device H shown in FIG. 8 and FIG. 9 has a lower rack arm I which is pin-connected to a top end Et of a transfer arm E and an upper rack arm J which is pin-connected to a cable fixing portion F located above the transfer arm E, and is configured with a pair of mutually parallel middle rack arms Ka, Kb pin-connected to free ends of the lower rack arm I and the upper rack arm J.

Since the cable holding device H configured as described above is deformed as the transfer arm E moves as shown in FIG. 8 and FIG. 9, a cable G which is connected to the cable fixing portion F located above the top end Et of the transfer arm E is held by the cable holding device H. Then, the cable G is not swung around unnecessarily by the behavior of the transfer arm E and can be prevented from being damaged unexpectedly.

Patent Literature 1: Japanese Utility Model Application Laid-open No. 1-118832

DISCLOSURE OF THE INVENTION

Problems to be Solved by the Invention

According to the cable holding device H configured as described above, the cable G is suppressed from being swung around by the behavior of the transfer arm E as described above. But, when the transfer arm E of the work transfer device A passes through the middle position as shown in FIG. 9, the lower rack arm I and the upper rack arm J are oscillated in a direction to separate from each other, and the middle rack arms Ka, Kb have a position to extend in a substantially horizontal direction. Therefore, where the cable holding device H is disposed between the mutually adjacent press machines P1 and P2, it is necessary to provide a large space in the work transfer direction, and it is hard to decrease the space (press-to-press pitch) between the press machines of the tandem press line.

Meanwhile, it is highly demanded for the tandem press line in these days that the space between the press machines is decreased as small as possible, and the tandem press line shown in FIG. 10 is designed to make the press-to-press pitch as small as possible by disposing a work transfer device Z as described later between the press machine P1 and the press machine P2.

The above-described work transfer device Z is configured by disposing the oscillating drive portion C as a rotatably supporting portion in a still manner (disabled from moving horizontally in the longitudinal direction of the beam B) on the beam B which is installed between the press machine P1 and the press machine P2 and swingably supporting the transfer arm E, which has the work holding means D such as a vacuum cup device or the like provided at the bottom end, by the oscillating drive portion C and movable along its axial direction, such that the transfer arm E is oscillated/moved in the axial direction by the oscillating drive portion C, and the work holding means D is moved horizontally to convey the work.

By adopting the work transfer device Z as described above, the press-to-press pitch of the parallel-disposed press machines can be set small, but the space between the adjacent press machines also becomes quite small. Therefore, it is naturally that there arise problems that the conventional cable holding device H shown in FIG. 8 and FIG. 9 could not be adopted and the press-to-press pitch of the parallel-disposed press machines must be set large.

The present invention has been made in view of the above circumstances and provides a cable holding device which can effectively treat a cable even in a small space between mutually adjacent press machines and can set the parallel disposed press machines to have a small press-to-press pitch between them.

Means to Solve the Problems

To achieve the above purposes, and according to a first aspect of the present invention, a cable holding device, which is used for a work transfer device that transfers a work between mutually adjacent press machines by disposing a supporting portion on a support member placed between mutually adjacent press machines, swingably supporting a transfer arm by the supporting portion, and moving work holding means provided at the bottom end of the transfer arm in a work transfer direction, and which holds a cable that is connected between a cable fixing portion disposed on the press machines and the top end of the transfer arm, comprising: a rack arm that is swingably connected to the top end of the transfer arm and holds a part of the cable; a slide supporter that swingably connects the rack arm, is disposed above the transfer arm, and vertically moved via the rack arm as the transfer arm moves; and a cable support that has its one end connected to the slide supporter and its other end connected to a cable fixing portion that is disposed in a direction intersecting a transfer direction of the work with respect to the slide supporter, supports a part of the cable, and is deformed by following the vertical movement of the slide supporter; wherein: the cable is held along the rack arm, the slide supporter, and the cable support.

According to a second aspect of the present invention, in the cable holding device according to the first aspect of the invention, the cable support is a flexible cable holder that has its one end connected to the slide supporter and the other end connected to the cable fixing portion.

According to a third aspect of the present invention, in the cable holding device according to the first aspect of the invention, the cable support is provided with a first rack arm and a second rack arm that are mutually connected swingably, the first rack arm is swingably connected to the slide supporter, and the second rack arm is swingably connected to the cable fixing portion.

EFFECTS OF THE INVENTION

According to the cable holding device of the first aspect of the invention, the cable rack is guided by the slide supporter to move in the vertical direction with the behavior of the transfer arm at the time of the work transfer, and the cable support that is provided along with the space between the adjacent press machines is moved in an intersectional direction from the slide supporter to the work transfer direction, in other words, vertically moved as the above-mentioned slider supporter moves. Therefore, the rack arm and the cable support which hold the cable do not project largely in the work transfer direction regardless of the position of the transfer arm, the cable can be treated effectively even in the small space between the mutually adjacent press machines, and the press-to-press pitch between the parallel-disposed press machines can be set small.

According to the cable holding device of the second aspect of the invention, the cable rack is moved in the vertical direction with the behavior of the transfer arm at the time of the work transfer and the cable support that comprises the flexible cable holder is moved in the vertical direction in the same manner as the cable holding device according to the first aspect of the invention. Therefore, the cable can be treated effectively even in the small space between the press machines, and the press-to-press pitch between the press machines can be set small.

According to the third aspect of the invention, the cable rack is moved in the vertical direction with the behavior of the transfer arm at the time of the work transfer, and the cable support which is configured by swingably connected to the first rack arm and the second rack arm is moved in the vertical direction in the same manner as the cable holding device according to the first aspect of the invention. Therefore, the cable can be treated effectively even in the small space between the press machines, and the press-to-press pitch between the press machines can be set small.

EXPLANATION OF REFERENCE NUMERALS

Figure 1:
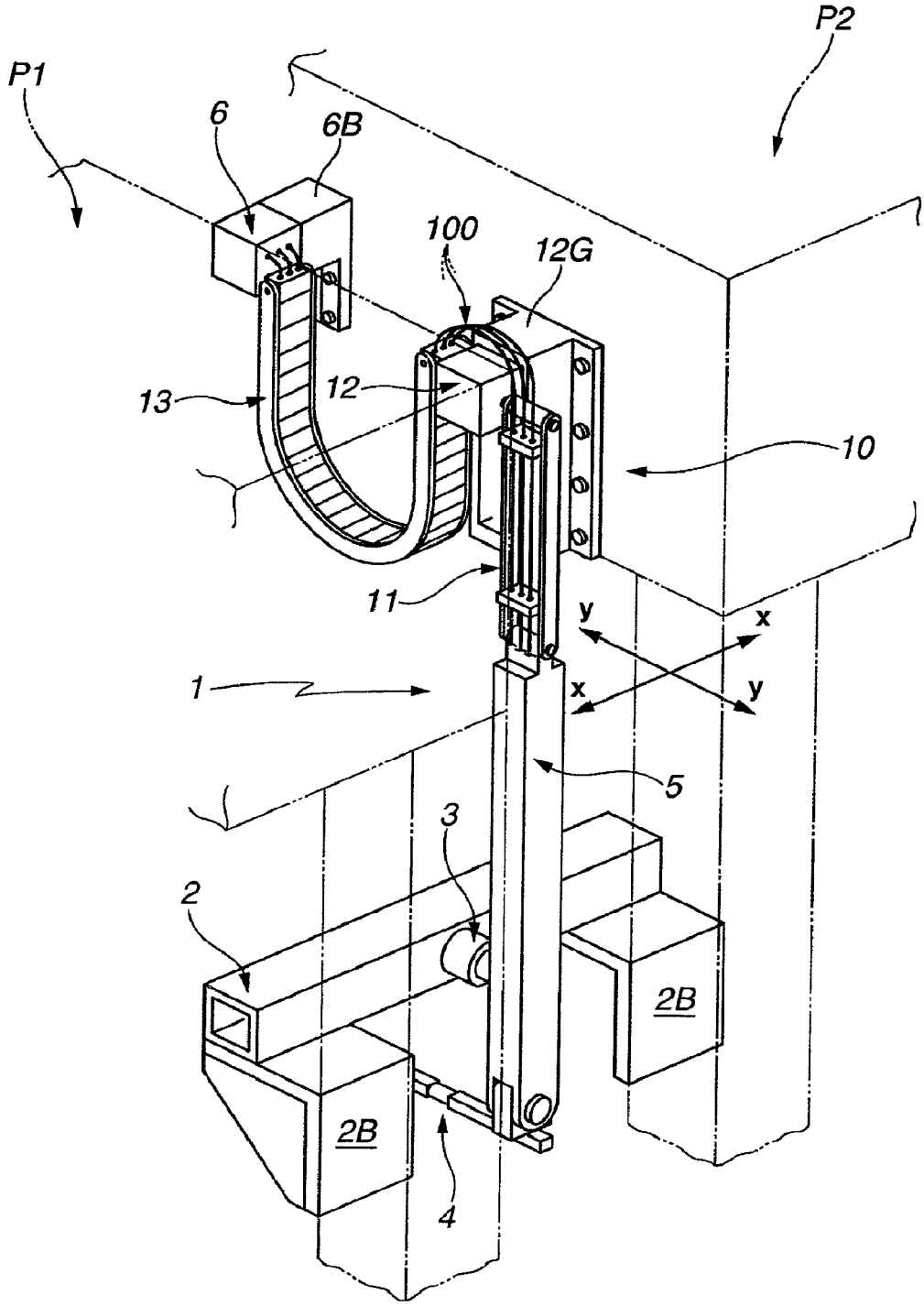
FIG. 1 is an appearance perspective view showing an embodiment of a cable holding device according to the present invention.

1, 1' work transfer device
2 beam (support member)
3 oscillating drive portion (supporting portion)
4 work holding means
5 transfer arm
6 fixing box (cable fixing portion)
10, 10' cable holding device
11 rack arm
12 slider (slide supporter or sliding support)
13 flexible cable holder (cable support)
20 cable support
21 first rack arm (first cable supporting arm)
22 second rack arm (second cable supporting arm)
100 cables
P1, P2 press machine

DETAILED DESCRIPTION OF THE INVENTION

The present invention will be described in detail with reference to the drawings showing embodiments.

FIG. 1 through FIG. 5 show an example of applying a cable holding device according to the present invention to a work transfer device 1 which is disposed between a press machine P1 and a press machine P2 which are adjacent to each other in a tandem press line comprising press machines disposed in parallel, discharges a work from a press processing position of the previous step and feeds the work into the press processing position of the next step.

Here, the press machine P1 and the press machine P2 which configure the tandem press line are determined to have a small press-to-press pitch (e.g., about 4200 mm). Thus, only a very small (e.g., about 660 mm) space is provided between the press machine P1 and the press machine P2 which are adjacent to each other.

The work transfer device 1 is provided with a beam (support member) 2 which is installed, via brackets 2B, 2B, between the press machine P1 and the press machine P2 which are adjacent to each other to extend in a work transfer direction (arrow x-x direction in FIG. 1, FIG. 2 and FIG. 4) and a horizontal direction, and an oscillating drive portion (rotatably supporting portion) 3 which is mounted on the beam 2.

The beam 2 is a member for supporting the oscillating drive portion 3, and may project in a cantilevered state from either of the press machine P1 or the press machine P2 or may be erected between the press machines P1, P2.

Additionally, the work transfer device 1 is provided with a transfer arm 5 which is provided with a work holding means 4 such as a vacuum cup device on its bottom end. This transfer arm 5 is supported by the oscillating drive portion 3 so to be oscillatable within the vertical plane along the longitudinal direction (work transfer direction) of the beam 2 and to be movable along the axial direction of the transfer arm 5.

In the work transfer device 1, the transfer arm 5 is oscillated by the driving force of the oscillating drive portion 3 and moved in its axial direction to move the work holding means 4 horizontally as indicated by the arrow x-x, thereby transferring the work between the press machine P1 and the press machine P2. It is also possible to control so as to move the work holding means 4 vertically.

Here, a power line and a signal line for driving the transfer arm 5 and a cable 100 such as hydraulic piping, air piping and the like for operating the work holding means 4 which is disposed on the bottom end of the transfer arm 5 are extended from the top end of the transfer arm 5. This cable 100 is routed through the space between the press machine P1 and the press machine P2, fixed to a fixing box (cable fixing portion) 6 which is mounted to the press machine P2, further extended and connected to unshown power source, air compressor and the like which are separately disposed on the press machines P1, P2.

Meanwhile, the cable holding device 10 for supporting the cable 100 which is connected between the fixing box 6 and the top end of the transfer arm 5 comprises a rack arm 11, a slider (slide supporter) 12 and a flexible cable holder (cable support) 13 to be described later. For the flexible cable body 13, a device which is called Cable Bear (registered trademark) is used by one skilled in the art.

Figure 2:
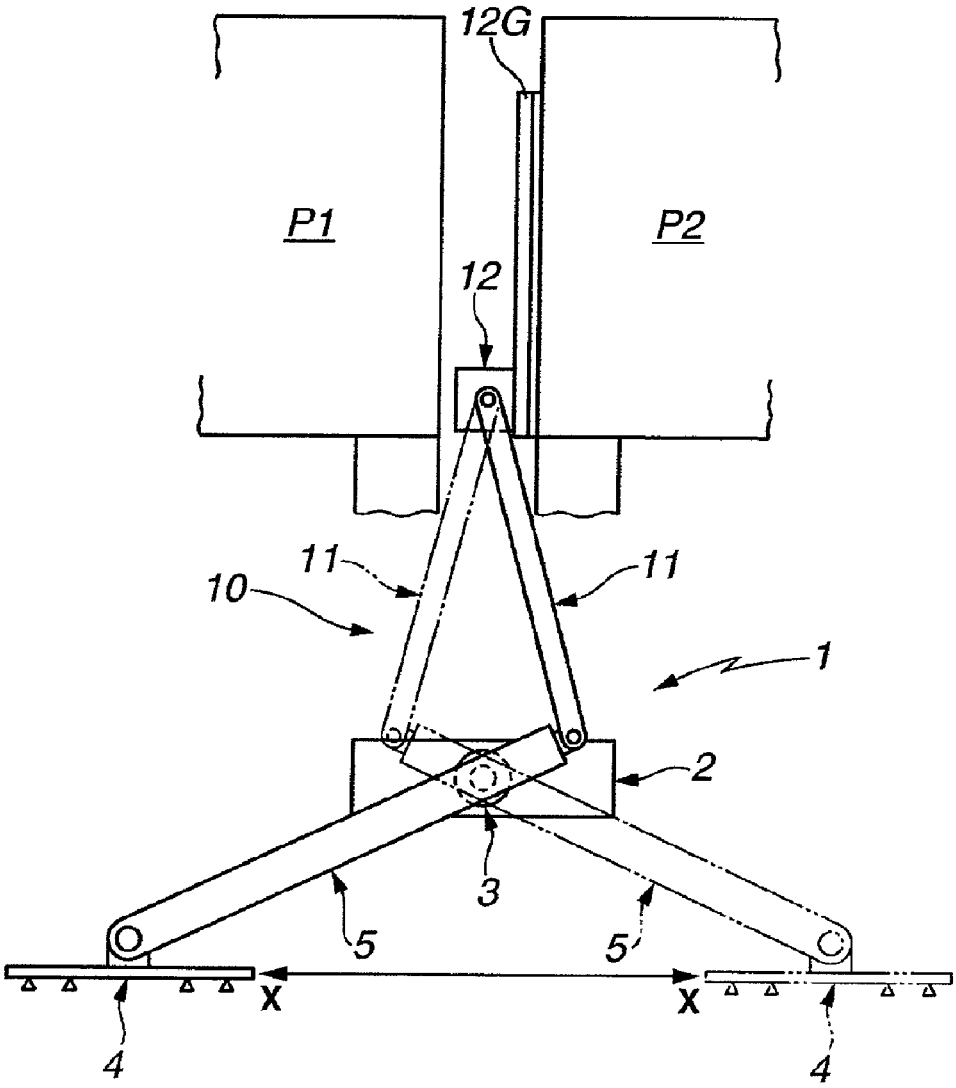
FIG. 2 is an appearance front view showing an operation mode of the cable holding device shown in FIG. 1.
Figure 4:
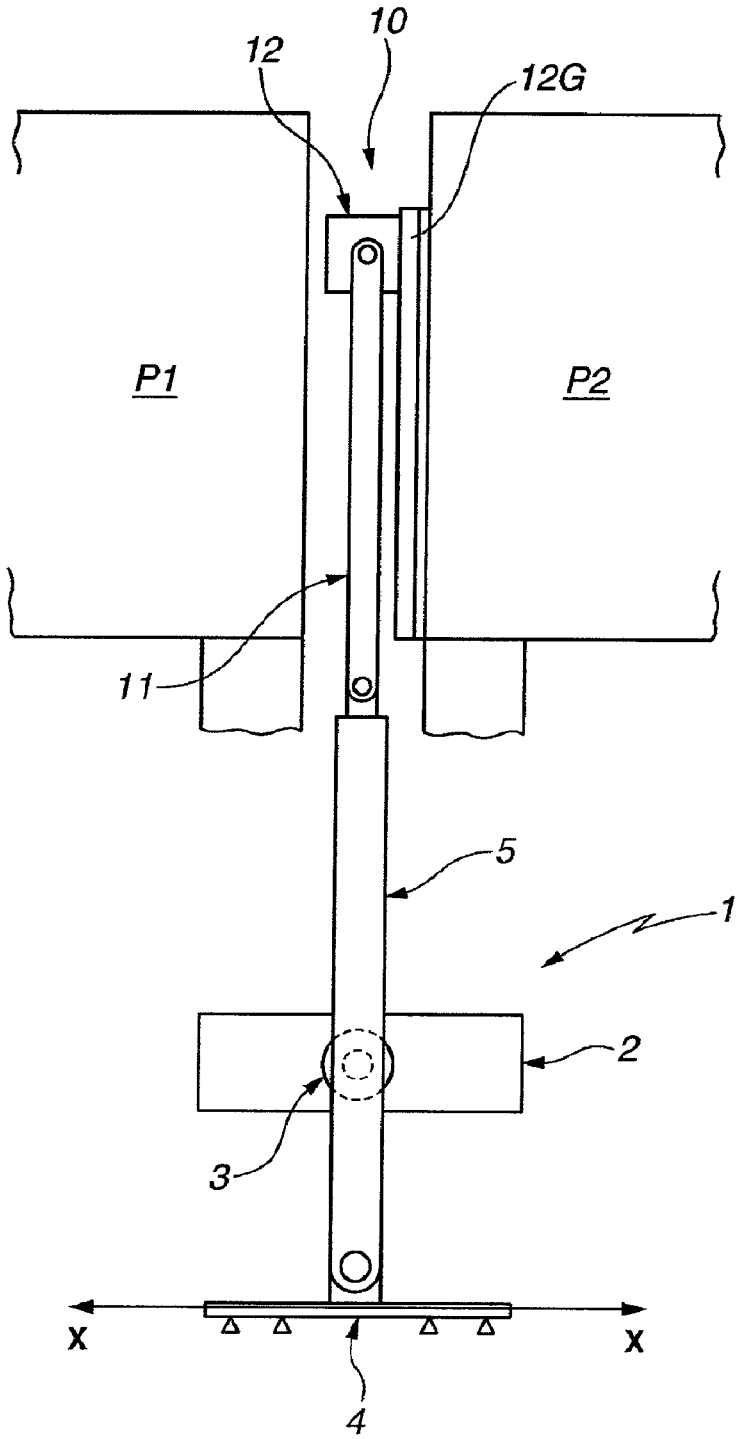
FIG. 4 is an appearance front view showing an operation mode of the cable holding device shown in FIG. 1.

The rack arm 11 is a so-called rudder rack which has a pair of side plates connected by a horizontal frame or a cable bracket, and its lower end is connected to the bracket at the top end of the transfer arm 5 through a spindle pin and supported swingably in a work transfer direction (horizontal direction on the sheets of FIG. 2 and FIG. 4).

Meanwhile, the slider 12 is disposed above the transfer arm 5 and movable in the vertical direction via a guide base 12G which is fixed to the wall surface of the press machine P2, and the top end of the rack arm 11 is connected to the side surface (the front in FIG. 2 and FIG. 4) of the slider 12 via a support pin.

As mentioned above, the rack arm 11 is supported swingably along the work transfer directions with respect to the top end of the transfer arm 5 and the side surface of the slider 12, and when the transfer arm 5 is moved as described later, the slider 12 is moved in the vertical direction via the rack arm 11.

Meanwhile, the fixing box 6 is disposed on the wall surface of the press machine P2 via a bracket 6B in a direction (arrow y-y direction in FIG. 1) to intersect the work transfer direction with respect to the slider 12, specifically, in the back region (on the left side in FIG. 3 and FIG. 5) with respect to the slider 12 in a state that the press machine P1 and the press machine P2 are viewed on either side.

The flexible cable holder 13 is extended as the cable support between the fixing box 6 and the slider 12. Its one end (the right end portion in FIG. 3 and FIG. 5) is connected to the slider 12, and the other end (the left end portion in FIG. 3 and FIG. 5) is connected to the fixing box 6. The flexible cable holder 13 follows the vertical movement of the slider 12 to vertically deform within the vertical plane along a direction (arrow y-y direction in FIG. 1) intersecting the work transfer direction.

Here, in the work transfer device 1 to which the cable holding device 10 is applied, when the work holding means 4 is moved in the horizontal direction to convey the work between the press machine P1 and the press machine P2, the top end of the transfer arm 5 is moved along a loop because the transfer arm 5 is oscillated and vertically moved by the oscillating drive portion 3 as indicated by the solid line in FIG. 2, the solid line in FIG. 4 and the chain double-dashed line in FIG. 2.

Figure 3:
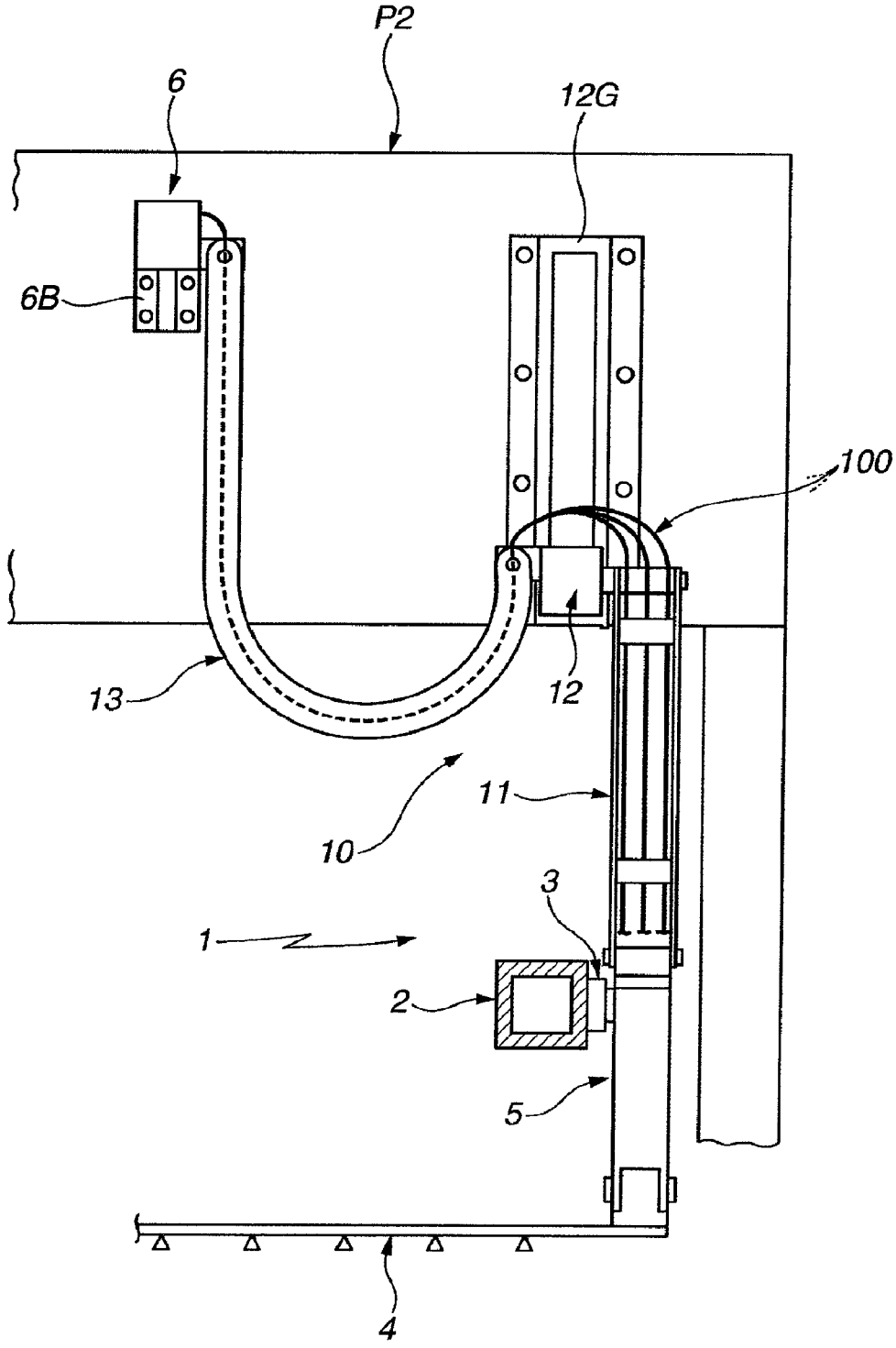
FIG. 3 is an appearance side view showing an operation mode of the cable holding device shown in FIG. 1.
Figure 5:
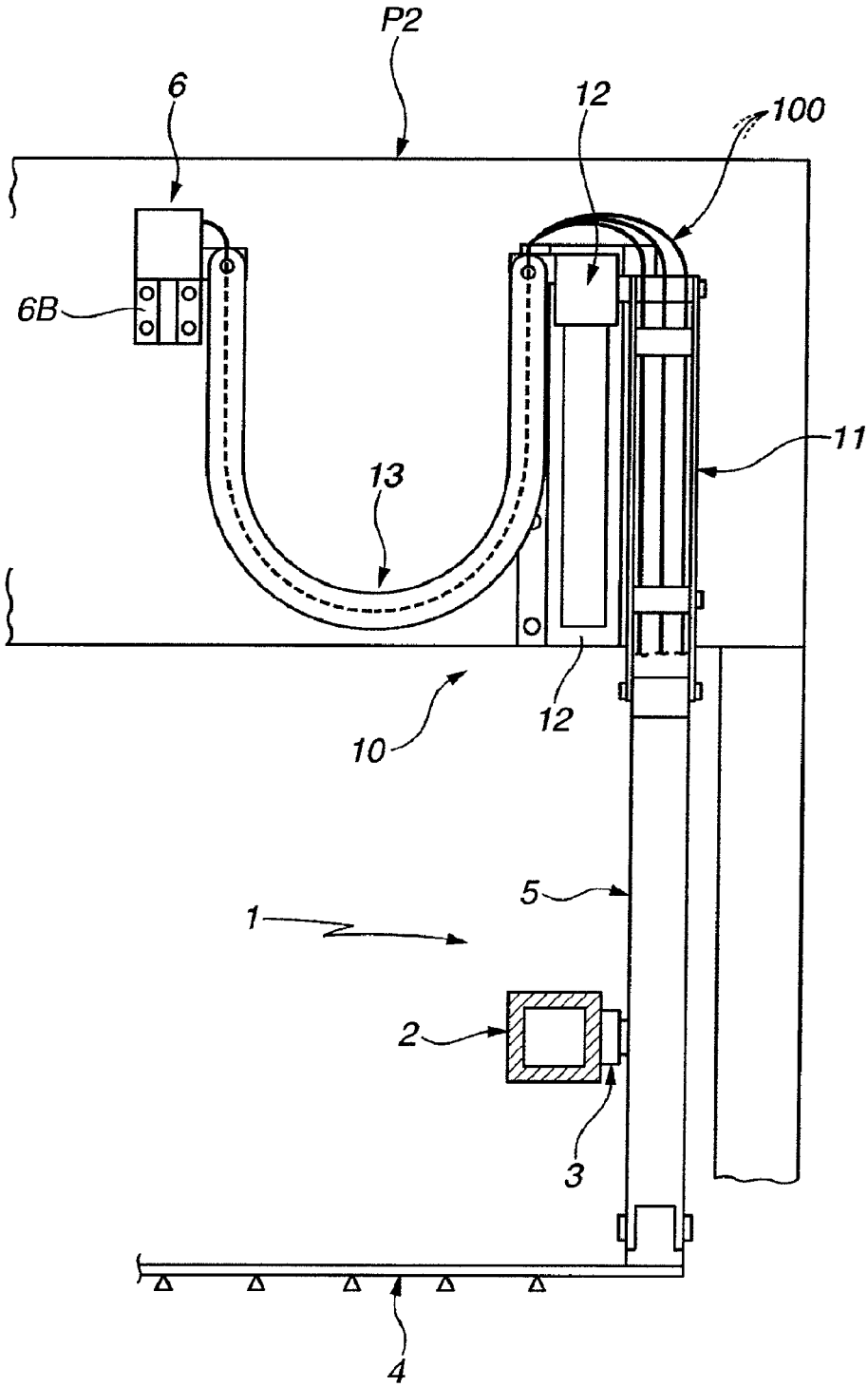
FIG. 5 is an appearance side view showing an operation mode of the cable holding device shown in FIG. 1.

As described above, the slider 12 is moved vertically via the rack arm 11 as the transfer arm 5 changes its position as shown in FIG. 2 and FIG. 4 (FIG. 3 and FIG. 5). In other words, the rack arm 11 which holds a part of the cable 100 is guided by the slider 12 to move in the vertical direction.

As the slider 12 moves vertically as described above, one end of the flexible cable holder 13 which is extended between the slider 12 and the fixing box 6 is moved vertically together with the slider 12 as shown in FIG. 3 and FIG. 5.

Thus, the flexible cable holder 13 which holds a part of the cable 100 is deformed in the vertical direction within the vertical plane along a direction intersecting the work transfer direction, specifically in the space between the press machine P1 and the press machine P2 as the slider 12 moves vertically.

Thus, in the cable holding device 10 configured as described above, the cable rack 11 is guided by the slider 12 to move in the vertical direction as the transfer arm 5 is moved, and the flexible cable holder 13 which is disposed from the slider 12 in a direction intersecting the work transfer direction is deformed in the vertical direction as the slider 12 is moved. Therefore, the rack arm 11 and the flexible cable holder 13 which hold the cable 100 do not project significantly in to the work transfer direction regardless of the position of the transfer arm 5.

As a result, the space related to the installation of the cable holding device 10 becomes as small as possible, so that the installation can be made even if the tandem press line has a small space between the mutually adjacent press machine P1 and press machine P2. Thus, the press-to-press pitch between the adjacent press machine P1 and press machine P2 can be set as small as possible, and it becomes possible to make the tandem press line as small as possible.

Figure 6:
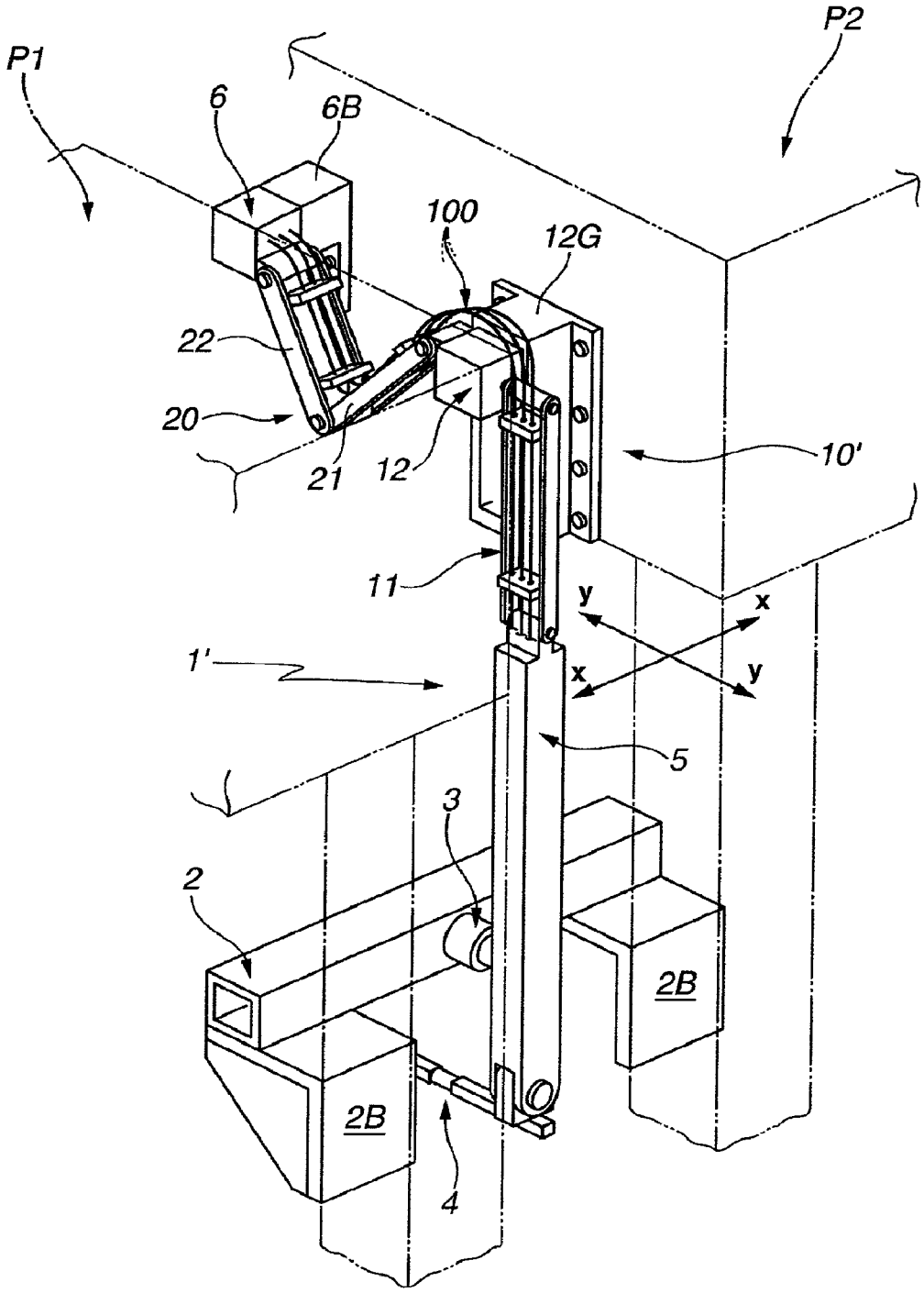
FIG. 6 is an appearance perspective view showing another embodiment of a cable holding device according to the present invention.
Figure 7:
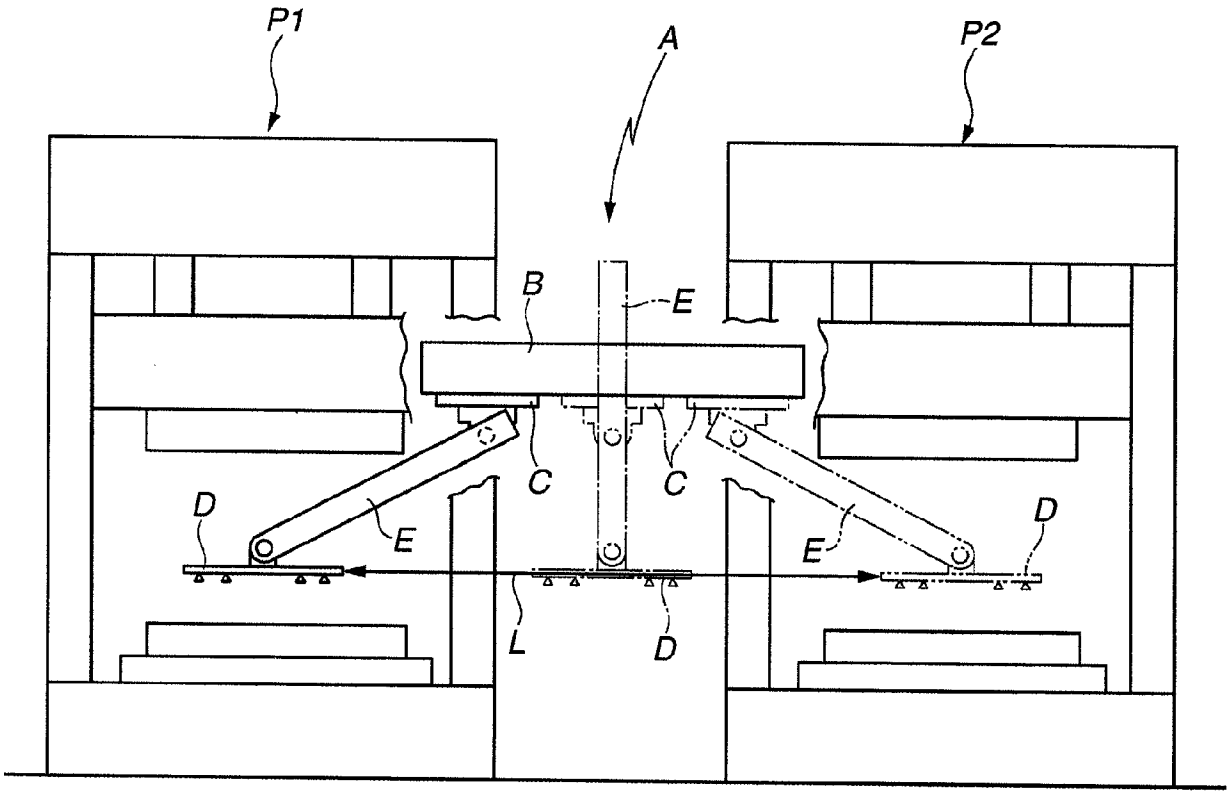
FIG. 7 is a conceptual view showing a tandem press line provided with a related work transfer device.
Figure 8:
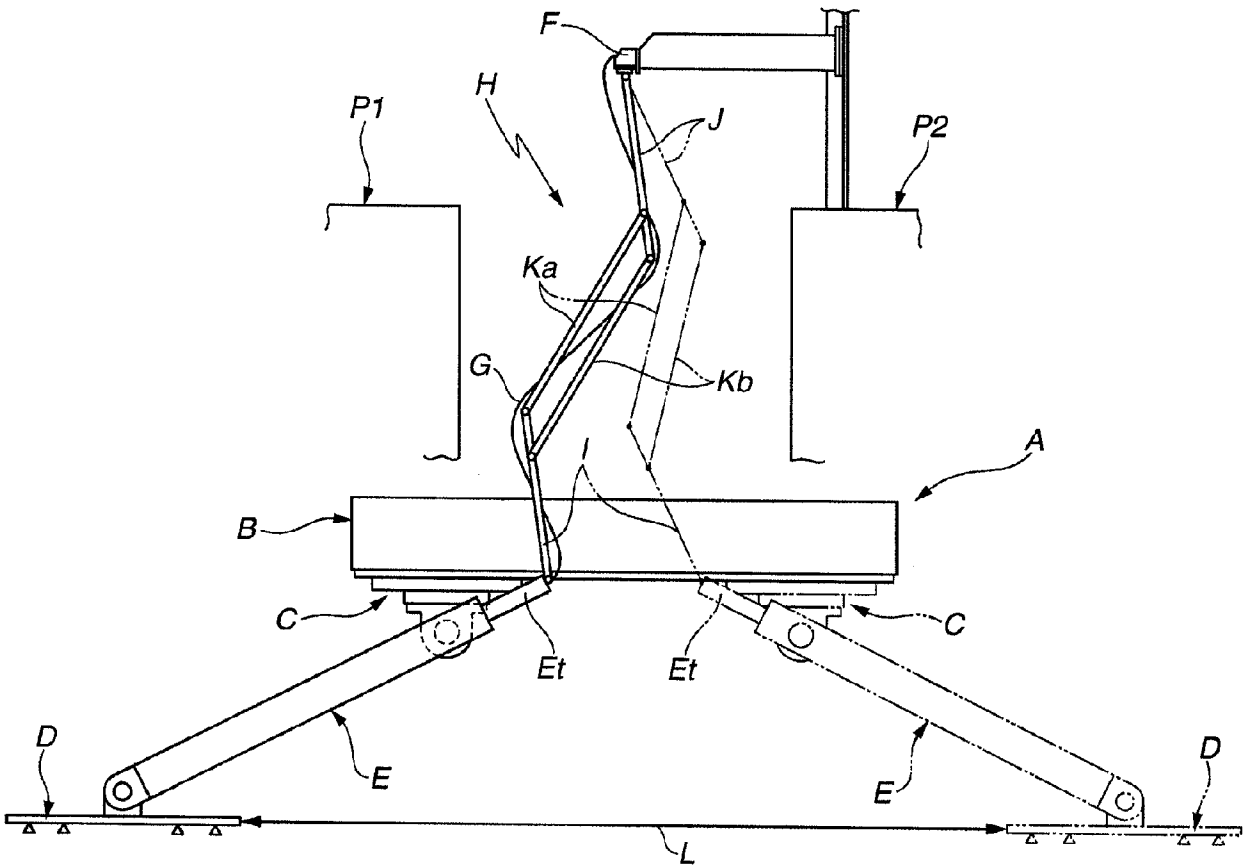
FIG. 8 is a conceptual view showing an operation mode of a related cable holding device.
Figure 9:
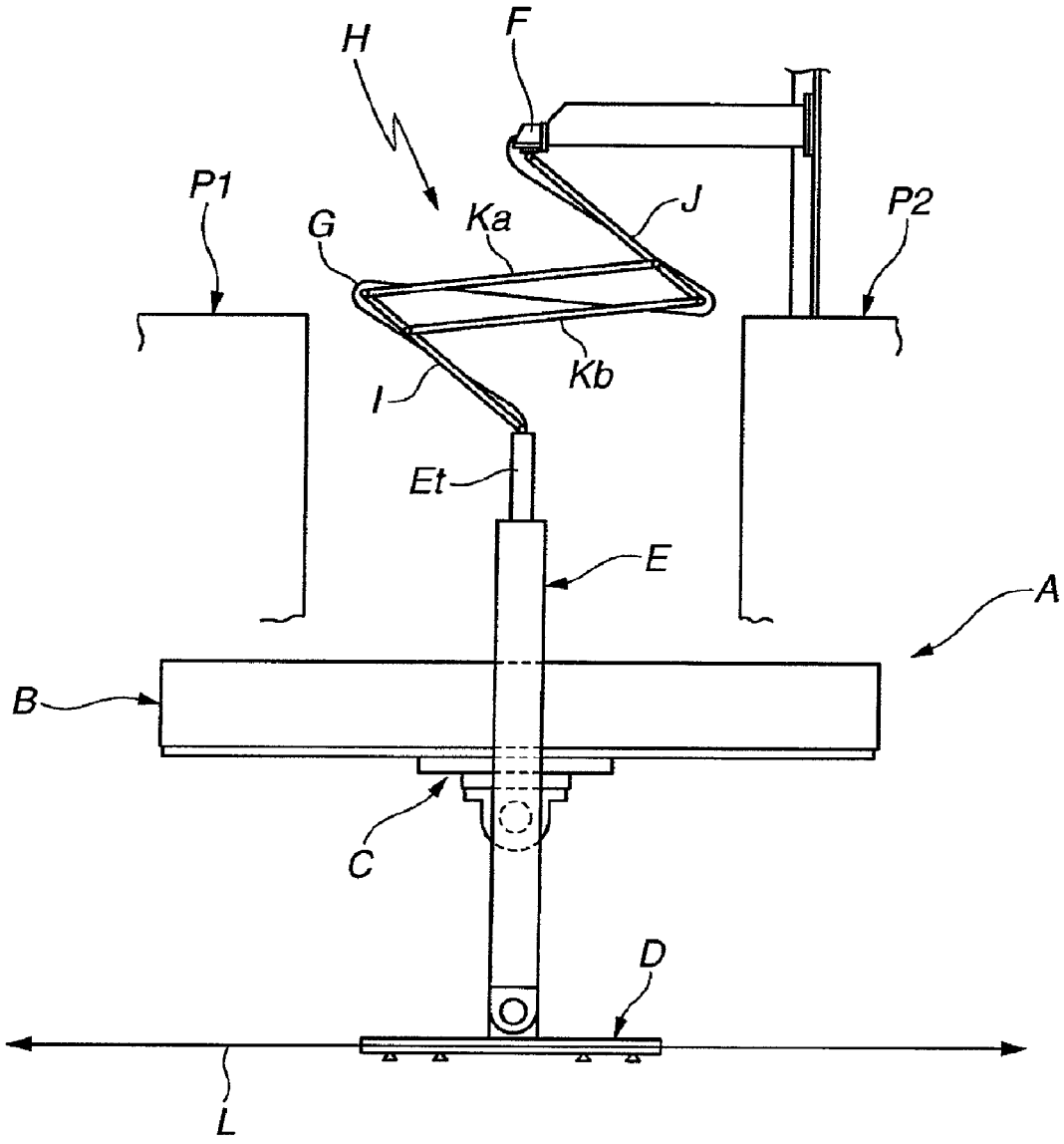
FIG. 9 is a conceptual view showing an operation mode of a related cable holding device.
Figure 10:
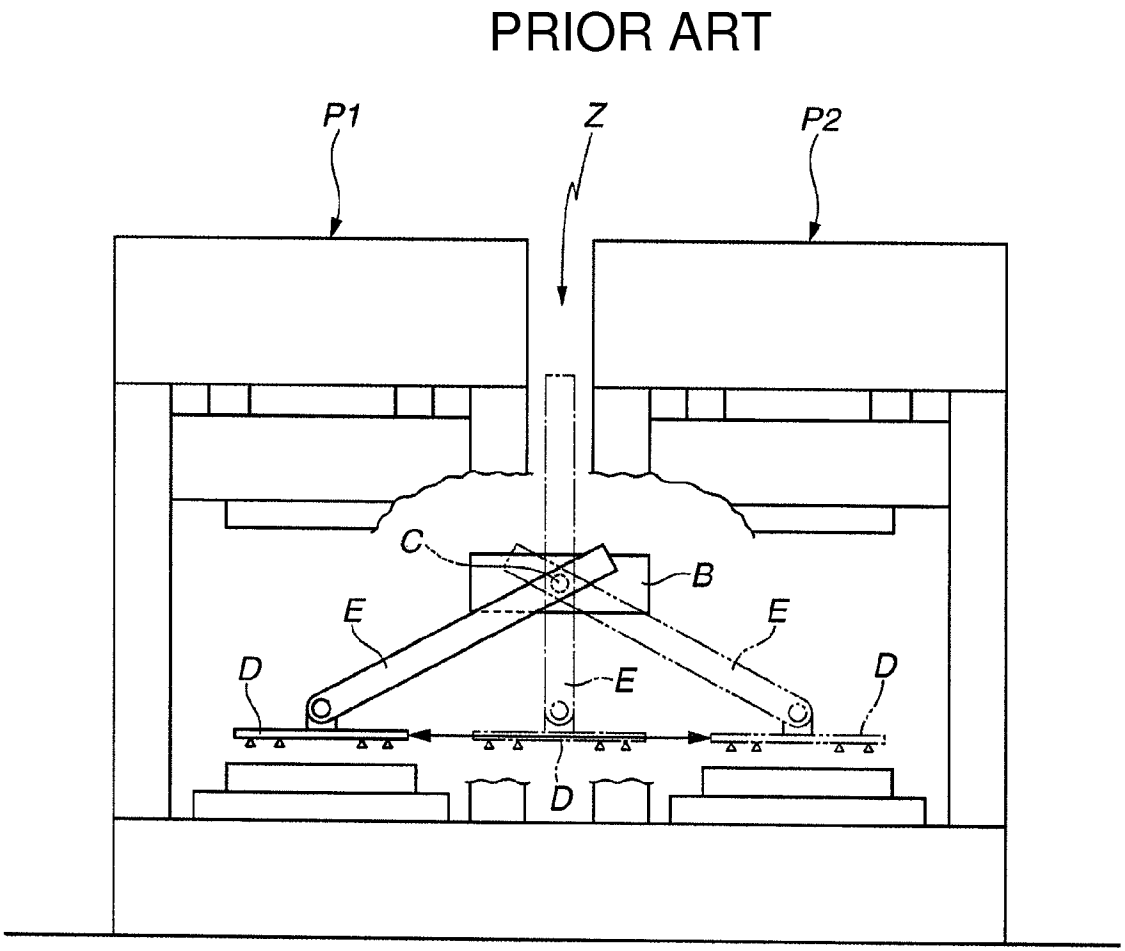
FIG. 10 is a conceptual view showing a tandem press line provided with a related work transfer device.

In a cable holding device 10' of a work transfer device 1' shown in FIG. 6, a cable support 20, which is provided with a first rack arm 21 and a second rack arm 22 which are mutually connected swingably, is extended between the fixing box 6 and the slider 12. The cable support 20, which has one end of the first rack arm 21 connected to the slider 12 and one end of the second rack arm 22 connected to the fixing box 6, follows the vertical movement of the slider 12 and bends in the vertical direction within the vertical plane along a direction (arrow y-y direction in FIG. 6) intersecting the work transfer direction.

The above-described cable holding device 10' of the work transfer device 1' is basically not different from the cable holding device 10 shown in FIG. 1 through FIG. 5 excepting the structure of the cable support 20. Therefore, in FIG. 6, the same reference numerals are allotted to the constituent elements of the work transfer device 1' and the cable holding device 10' which provide the same actions as those of the work transfer device 1 and the cable holding device 10 in FIG. 1 through FIG. 5, and their detailed description is omitted.

In the cable holding device 10' configured as described above, the cable rack 11 is guided by the slider 12 to move in the vertical direction as the transfer arm 5 is moved, and the cable support 20 which is disposed from the slider 12 in the direction intersecting the work transfer direction is deformed in the vertical direction as the slider 12 is moved. Therefore, the rack arm 11 and the cable support 20 which hold the cable 100 do not project largely to the work transfer direction regardless of the position of the transfer arm 5.

As a result, the space related to the installation of the cable holding device 10' can be made as small as possible, and it becomes possible to install even if a tandem press line has a small space between the mutually adjacent press machine P1 and press machine P2. Thus, the press-to-press pitch between the mutually adjacent press machine P1 and press machine P2 can be set as small as possible, and it becomes possible to make the tandem press line as small as possible.

In the above-described embodiments, the cable support is configured with the flexible cable holder or the pair of rack arms which are swingably connected, but it is needless to say that various mechanisms can be adopted as the cable support if the cable 100 can be held between the slider and the fixing box by the cable support which deforms by following the vertically moving slider 12.

In the above-described embodiments, the transfer arm 5 is movable in the axial direction at the oscillating drive portion (supporting portion) 3, but the beam 2 may be configured to be movable vertically, and the work holding means 4 can also be made movable along the axial direction of the transfer arm 5.

The example of applying the cable holding device according to the present invention to the work transfer device of the tandem press line which comprises the press machines arranged in parallel has been described in the above-described embodiments. However, the cable holding device according to the present invention can also be applied to a work transfer device which transfers a work between the mutually adjacent processing stations of a progressive press line.

Additionally, it is needless to say that the cable holding device according to the present invention can be applied effectively not only to the processing line which comprises press machines but also to the work transfer device of various work lines.

The invention claimed is:

1. A cable holding device for use with a work transfer device that transfers work between adjacent press machines, the work transfer device including a support member disposed between the press machines, a supporting portion disposed on the support member, a transfer arm pivotably supported by the supporting portion, a working holding unit disposed at a bottom end of the transfer arm and being movable in a work transfer direction, a cable fixing portion disposed on one of the press machines, and a cable connected to the cable fixing portion and a top end of the transfer arm, the cable holding device comprising:

a rack arm pivotably connectable to the top end of the transfer arm, said rack arm being configured to hold the cable;

a sliding support disposable above the transfer arm, said sliding support being movable in a vertical direction as said rack arm and the transfer arm move, said rack arm being pivotably connected to said sliding support; and a cable support having a first end connected to said sliding support and a second end for connecting to the cable fixing portion, said cable support being configured to hold the cable, and said first end being connected to said sliding support such that said first end follows movement of said sliding support in the vertical direction, wherein said cable support deforms as said first end follows movement of said sliding support in the vertical direction, and wherein the cable is held along said rack arm, said sliding support, and said cable support.

2. The cable holding device according to claim 1, wherein said cable support is a flexible cable holder.

3. The cable holding device according to claim 1, wherein the cable support is comprised of a first cable supporting arm and a second cable supporting arm pivotably connected to said first cable supporting arm, wherein said first cable supporting arm is pivotably connected to said sliding support, and wherein said second cable supporting arm is pivotably connectable to the cable fixing portion.

* * * * *